US010094014B2

(12) United States Patent
Umehara et al.

(10) Patent No.: US 10,094,014 B2
(45) Date of Patent: Oct. 9, 2018

(54) NITRIDING METHOD AND NITRIDED PART PRODUCTION METHOD

(71) Applicant: NIPPON STEEL & SUMITOMO METAL CORPORATION, Tokyo (JP)

(72) Inventors: Takahide Umehara, Futtsu (JP); Yoshihiro Daito, Kisarazu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 91 days.

(21) Appl. No.: 15/123,732

(22) PCT Filed: Mar. 10, 2015

(86) PCT No.: PCT/JP2015/001281

§ 371 (c)(1),
(2) Date: Sep. 6, 2016

(87) PCT Pub. No.: WO2015/136917

PCT Pub. Date: Sep. 17, 2015

(65) Prior Publication Data

US 2017/0016107 A1 Jan. 19, 2017

(30) Foreign Application Priority Data

Mar. 13, 2014 (JP) ..... 2014-050504

(51) Int. Cl.
*C23C 8/24* (2006.01)
*C23C 8/26* (2006.01)
(Continued)

(52) U.S. Cl.
CPC ..... *C23C 8/26* (2013.01); *C21D 1/06* (2013.01); *C21D 1/76* (2013.01)

(58) Field of Classification Search
CPC ..... C23C 8/24; C23C 8/26
See application file for complete search history.

(56) References Cited

U.S. PATENT DOCUMENTS 3,705,058 A * 12/1972 Kolozsvari et al. ..... C23C 8/26 148/230
6,024,893 A * 2/2000 Keil ..... C23C 8/24 148/206

(Continued)

FOREIGN PATENT DOCUMENTS

| | | | |
|---|---|---|---|
| JP | 11-124653 | * | 5/1999 |
| JP | 2006-028588 | | 2/2006 |
| JP | 2007-031759 | | 2/2007 |

*Primary Examiner* — Matthew E. Hoban
(74) *Attorney, Agent, or Firm* — Clark & Brody

(57) ABSTRACT

A low alloy steel is heated to a temperature ranging from 550 to 620° C., and high $K_N$ and low $K_N$ value processes are performed for a total process time of A: 1.5 to 10 hours. In the high $K_N$ value process, a nitriding potential $K_{NX}$ given by Formula (1): 0.15 to 1.50, the average $K_{NX}$ value $K_{NXave}$: 0.30 to 0.80, and the process time is X in hours. In the low $K_N$ value process, which is performed after the high $K_N$ value process, a nitriding potential $K_{NY}$ given by Formula (1): 0.02 to 0.25, the average $K_{NY}$ value $K_{NYave}$: 0.03 to 0.20, and the process time is Y in hours. Average nitriding potential value $K_{Nave}$ determined by Formula (2) ranges from 0.07 to 0.30.

$$K_{Ni}=(NH_3 \text{ partial pressure})/(H_2 \text{ partial pressure})^{3/2}] \quad (1)$$

$$K_{Nave}=(X\times K_{NXave}+Y\times K_{NYave})/A \quad (2)$$

where i is X or Y.

2 Claims, 3 Drawing Sheets

(51) Int. Cl.
*C21D 1/06* (2006.01)
*C21D 1/76* (2006.01)

(56) References Cited

U.S. PATENT DOCUMENTS 6,093,263 A * 7/2000 Kobayashi ..... C21D 9/32
148/228
9,693,653 B2 * 7/2017 Cavallotti ..... C25D 5/50

* cited by examiner

NITRIDING METHOD AND NITRIDED PART PRODUCTION METHOD

TECHNICAL FIELD

The present invention relates to a nitriding method and a nitrided part production method, and more particularly, to a method for nitriding low alloy steels and a method for producing nitrided parts therefrom.

BACKGROUND ART

For steel parts used in motor vehicles, various industrial machines, etc., a case hardening heat treatment such as carburizing-quenching, induction hardening, nitriding, or nitrocarburizing is applied to improve their mechanical properties such as fatigue strength, wear resistance, and seizure resistance. The nitriding process and the nitrocarburizing process both use a heat treatment in the ferrite region at a heating temperature not more than the $A_1$ temperature without utilizing phase transformation. As a result, heat treatment-induced distortion can be reduced. For this reason, the nitriding process or the nitrocarburizing process is frequently used for parts having high dimensional accuracy and large parts, examples of which include gears used in automotive transmission parts and crankshafts used in engines. In particular, the nitriding process requires fewer types of gas for the process than the nitrocarburizing process, so that atmosphere control therefor is easier.

Examples of nitriding processes include the gas nitriding process, the salt bath nitriding process, and the plasma nitriding process. For automotive parts or the like, the gas nitriding process, which has high productivity, is widely employed. The gas nitriding process can result in formation of a compound layer having a thickness of 10 μm or more on the surface of the steel material. The compound layer contains nitrides such as $Fe_{2-3}N$ and $Fe_4N$, and the hardness of the compound layer is much higher than that of the base metal of the steel part. Thus, the compound layer enhances the wear resistance and surface fatigue strength of the steel part at an early stage of use.

However, the compound layer has low toughness and low deformability and therefore is more likely to experience delamination or cracking during use. For this reason, nitrided parts processed by gas nitriding are not suitable for use as parts that can be subjected to impact stresses or high bending stresses. Furthermore, in the gas nitriding process, although heat treatment-induced distortion is reduced, straightening is sometimes necessary for long parts such as shafts and crankshafts. In such an instance, depending on the thickness of the compound layer, cracking may occur during straightening and this can decrease the fatigue strength of the part.

Accordingly, there is a need for a gas nitriding process that can provide a thinner compound layer or even eliminate the compound layer. By the way, it is known that the thickness of the compound layer can be controlled by the process temperature of the nitriding process and the nitriding potential $K_N$ determined by the following formula using the $NH_3$ partial pressure and $H_2$ partial pressure.

$$K_N = (NH_3 \text{ partial pressure})/[(H_2 \text{ partial pressure})^{3/2}]$$

By lowering the nitriding potential $K_N$, it is possible to provide a thinner compound layer or even to eliminate a compound layer. However, when the nitriding potential $K_N$ is low, ease of nitrogen penetration into the steel is reduced. In such an instance, the hardened case referred to as a nitrogen diffusion layer will have reduced hardness and reduced depth. As a result, the nitrided parts will have reduced fatigue strength, wear resistance, and seizure resistance. Another technique to eliminate the compound layer is, for example, machine grinding or shot blasting of the nitrided parts after the gas nitriding process. However, this technique results in higher production cost.

To respond to these problems, one proposed technique is to control the atmosphere for the gas nitriding process using a nitriding parameter, $K_{N'} = (NH_3 \text{ partial pressure})/[(H_2 \text{ partial pressure})^{1/2}]$, which is different from the above-mentioned nitriding potential, and to thereby form a hardened case having a uniform depth (e.g., Patent Literature 1). Another proposed technique is to use, in the nitrogen penetration process, a jig having a surface made of a non-nitridable material for placement of a workpiece to be nitrided in the treatment furnace (e.g., Patent Literature 2).

By using the nitriding parameter proposed by Patent Literature 1, it is possible to inhibit the formation of the compound layer on the outermost surface in a short time. However, sometimes, sufficient hardened case depth cannot be obtained for certain characteristics required. Further, when a non-nitridable jig is prepared to perform a fluorination process as proposed in Patent Literature 2, there are additional problems such as selection of a jig and increased man hours.

CITATION LIST

Patent Literature

Patent Literature 1: Japanese Patent Application Publication No. 2006-28588

Patent Literature 2: Japanese Patent Application Publication No. 2007-31759

SUMMARY OF INVENTION

An object of the present invention is to provide a method for nitriding low alloy steels with which the formation of the compound layer can be inhibited and sufficient case hardness and hardened case depth can be achieved.

A nitriding method according to the present embodiment includes a gas nitriding step in which a low alloy steel is heated to a temperature ranging from 550 to 620° C. in a gas atmosphere containing $NH_3$, $H_2$, and $N_2$, and the gas nitriding step being performed for a total process time of A ranging from 1.5 to 10 hours. The gas nitriding step includes a step of performing a high $K_N$ value process and a step of performing a low $K_N$ value process. The step of performing a high $K_N$ value process is carried out with a nitriding potential $K_{NX}$ determined by Formula (1) ranging from 0.15 to 1.50 and with an average value $K_{NXave}$ of the nitriding potential $K_{NX}$, the average value $K_{NXave}$ ranging from 0.30 to 0.80, and the high $K_N$ value process being performed for a process time of X in hours. The step of performing a low $K_N$ value process is performed after the high $K_N$ value process has been performed. The low $K_N$ value process is performed with a nitriding potential $K_{NY}$ determined by the following Formula (1) ranging from 0.02 to 0.25 and with an average value $K_{NYave}$ of the nitriding potential $K_{NY}$, the average value $K_{NYave}$ ranging from 0.03 to 0.20, and the low $K_N$ value process being performed for a process time of Y in hours. An average nitriding potential value $K_{Nave}$ determined by Formula (2) ranges from 0.07 to 0.30.

$$K_{Ni}=(NH_3 \text{ partial pressure})/[(H_2 \text{ partial pressure})^{3/2}] \quad (1)$$

$$K_{Nave}=(X\times K_{NXave}+Y\times K_{NYave})/A \quad (2)$$

where i is X or Y.

With the nitriding method of the present embodiment, it is possible to inhibit the formation of the compound layer and achieve sufficient hardened case depth.

DESCRIPTION OF EMBODIMENTS

Figure 1:
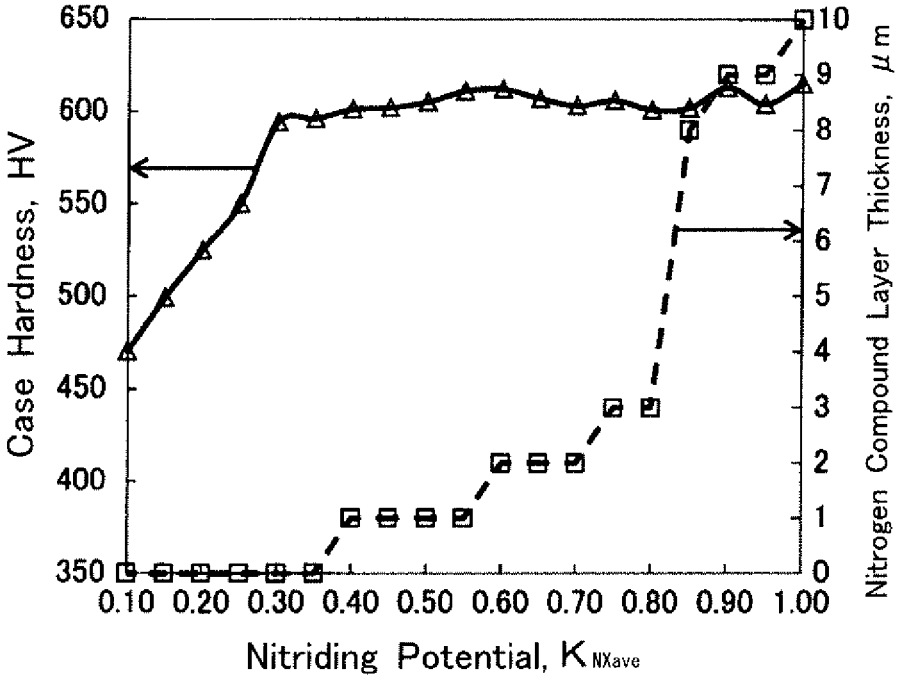
FIG. 1 is a graph illustrating the relationships between the average value $K_{NXave}$ of the nitriding potential of the high $K_N$ value process and the case hardness and also the compound layer thickness.

Hereinafter, an embodiment of the present invention will be described in detail with reference to the drawings. The same reference symbols will be used throughout the drawings to refer to the same or like parts, and description thereof will not be repeated.

The present inventors searched for methods to reduce the thickness of the compound layer, which is formed on the surface of a low alloy steel by a nitriding process, and also to achieve a deep hardened case. Furthermore, they also searched for methods to inhibit the formation of pores near the surface of the low alloy steel due to gasification of nitrogen during a nitriding process (particularly during a process with a high $K_N$ value). Consequently, the present inventors have made the following findings (a) to (c).

(a) $K_N$ Value in Gas Nitriding Process

Commonly, the $K_N$ value is defined by the following formula using the $NH_3$ partial pressure and $H_2$ partial pressure in the atmosphere of the furnace where the gas nitriding process takes place (sometimes referred to as nitriding atmosphere or simply as atmosphere).

$$K_N=(NH_3 \text{ partial pressure})/[(H_2 \text{ partial pressure})^{3/2}]$$

The $K_N$ value can be controlled by the gas flow rate. However, a certain period of time is necessary before the $K_N$ value of the nitriding atmosphere reaches an equilibrium after the flow rate is set. Thus, the $K_N$ value varies from moment to moment before the $K_N$ value reaches the equilibrium. Also, when the $K_N$ value is changed in the middle of the gas nitriding process, the $K_N$ value varies before reaching the equilibrium.

The $K_N$ value variation described above affects the compound layer, case hardness, and hardened case depth. Therefore, by controlling the variation range of the $K_N$ value during the gas nitriding process, as well as the average value of the $K_N$ value, to be within a predetermined range, it will be possible to ensure sufficient hardened case depth and also to inhibit the formation of the compound layer.

(b) Compatibility of Inhibiting Compound Layer Formation and Ensuring Case Hardness and Hardened Case Depth, in Combination A more effective way to form the hardened case is to use the compound layer as a nitrogen supply source. In order to inhibit the formation of the compound layer and to ensure the hardened case depth, the $K_N$ value may be controlled so that: the compound layer can be formed during the first part of the gas nitriding process; and the compound layer can be decomposed during the latter part of the gas nitriding process and substantially disappears at the end of the gas nitriding process. Specifically, for the first part of the gas nitriding process, a gas nitriding process (a high $K_N$ value process) with a high nitriding potential may be performed. Then, for the latter part of the gas nitriding process, a gas nitriding process (a low $K_N$ value process) with a nitriding potential lower than that of the high $K_N$ value process may be performed. Consequently, the compound layer formed in the high $K_N$ value process will decompose in the low $K_N$ value process, which will promote the formation of the nitrogen diffusion layer (hardened case). As a result, it is possible to obtain nitrided parts in which the compound layer is inhibited and having a higher case hardness and a deeper hardened case depth are available.

(c) Inhibiting Pore Formation

When the compound layer is formed by the nitriding process with a high $K_N$ value in the first part of the gas nitriding process, a layer containing pores (referred to as porous layer) sometimes forms. In such an instance, even after the nitrogen diffusion layer (hardened case) has been formed by the decomposition of nitrides, the pores sometimes remain as they are in the nitrogen diffusion layer. Pores remaining in the nitrogen diffusion layer will result in a decrease in fatigue strength and straightenability (probability of cracking in the hardened case due to straightening operation) of the nitrided parts. By regulating the upper limit of the $K_N$ value when the compound layer is formed in the high $K_N$ value process, the formation of the porous layer and pores can be inhibited to the greatest possible extent.

The nitriding method of the present embodiment, which has been accomplished based on the above findings, includes a gas nitriding step in which a low alloy steel is heated to a temperature ranging from 550 to 620° C. in a gas atmosphere containing $NH_3$, $H_2$, and $N_2$, and the total process time A ranges from 1.5 to 10 hours. The gas nitriding step includes a step of performing a high $K_N$ value process and a step of performing a low $K_N$ value process. In the step of performing a high $K_N$ value process, the nitriding potential $K_{NX}$ determined by Formula (1) ranges from 0.15 to 1.50, the average value $K_{NXave}$ of the nitriding potential $K_{NX}$ ranges from 0.30 to 0.80, and the process time is X in hours. The step of performing a low $K_N$ value process is performed after the high $K_N$ value process has been performed. In the low $K_N$ value process, the nitriding potential $K_{NY}$ determined by Formula (1) ranges from 0.02 to 0.25, the average value $K_{NYave}$ of the nitriding potential $K_{NY}$ ranges from 0.03 to 0.20, and the process time is Y in hours. The average nitriding potential value $K_{Nave}$ determined by Formula (2) ranges from 0.07 to 0.30.

$$K_{Ni}=(NH_3 \text{ partial pressure})/[(H_2 \text{ partial pressure})^{3/2}] \quad (1)$$

$$K_{Nave}=(X\times K_{NXave}+Y\times K_{NYave})/A \quad (2)$$

where i is X or Y.

With the nitriding method described above, it is possible to reduce the thickness of the compound layer to be formed on the surface of a low alloy steel while preferably inhibiting the formation of pores (porous layer) and further to obtain high case hardness and a deep hardened case. Consequently, nitrided parts (low alloy steel parts) produced by carrying out this nitriding process exhibit higher mechanical properties including fatigue strength, wear resistance, and seizure resistance and also exhibit higher straightenability.

A nitrided part production method of the present embodiment includes a step of preparing a low alloy steel and a step of performing the above-described nitriding method on the low alloy steel to produce a nitrided part.

A nitriding method and nitrided part production method according to the present embodiment will now be described in detail.

[Nitriding Method]

The nitriding method according to the present embodiment is designed to perform a gas nitriding process on a low alloy steel. The process temperature for the gas nitriding process ranges from 550 to 620° C. and the process time A for the entire gas nitriding process ranges from 1.5 to 10 hours.

[Material to be Gas-Nitrided]

Firstly, a low alloy steel, for which the nitriding method of the present embodiment is intended, is prepared. A low alloy steel as referred to in this specification is defined as a steel including 93% by mass or more of Fe, or more preferably, 95% by mass or more of Fe. Examples of low alloy steels as referred to in this specification include carbon steels for machine structural use specified in JIS G 4051, structural steels with specified hardenability bands specified in JIS G 4052, and low-alloyed steels for machine structural use specified in JIS G 4053. The contents of the alloying elements in the low alloy steel may fall outside the ranges specified in the JIS standard mentioned above. The low alloy steel may further include, as necessary, an element that is effective in increasing the hardness of the near-surface portion in the gas nitriding process, e.g., Ti, V, Al, or Nb, or other elements than these.

[Process Temperature: 550 to 620° C.]

The temperature of a gas nitriding process (nitriding temperature) largely correlates with the nitrogen diffusion rate and affects the case hardness and the hardened case depth. Too low a nitriding temperature leads to a slower nitrogen diffusion rate, which will result in a lower case hardness and a shallower hardened case depth. On the other hand, a nitriding temperature exceeding the $A_{C1}$ temperature leads to formation, in the steel, of the austenite phase (γ phase), in which the nitrogen diffusion rate is slower than in the ferrite phase (α phase), and this will result in a lower case hardness and a shallower hardened case depth. Accordingly, in the present embodiment, the nitriding temperature is within a range of 550 to 620° C. This makes it possible to inhibit the decrease in case hardness and also to inhibit the reduction in hardened case depth.

[Process Time A for Entire Gas Nitriding Process: 1.5 to 10 Hours]

In the present embodiment, the gas nitriding process is performed in an atmosphere containing $NH_3$, $H_2$, and $N_2$. The time period for the entire nitriding process, i.e., the time period (process time A) from the beginning of the nitriding process to the end thereof, correlates with the formation and decomposition of the compound layer and with the penetration of nitrogen, and thus affects the case hardness and the hardened case depth. Too short process time A will result in a lower case hardness and a shallower hardened case depth. On the other hand, too long process time A leads to denitrification, which will result in a decrease in the case hardness of the steel. Furthermore, too long process time will result in an increased production cost. Accordingly, the process time A for the entire nitriding process is within the range of 1.5 to 10 hours.

The atmosphere for the gas nitriding process of the present embodiment inevitably contains impurities such as oxygen and carbon dioxide in addition to $NH_3$, $H_3$, and $N_2$. The atmosphere preferably contains $NH_3$, $H_2$, and $N_2$ in a total amount of 99.5% or more (by volume).

[High $K_N$ Value Process and Low $K_N$ Value Process]

The above-described gas nitriding process includes a step of performing a high $K_N$ value process and a step of performing a low $K_N$ value process. In the high $K_N$ value process, the gas nitriding process is performed with a nitriding potential $K_{NX}$ that is higher than that for the low $K_N$ value process. Further, after the high $K_N$ value process, the low $K_N$ value process is performed. In the low $K_N$ value process, the gas nitriding process is performed with a nitriding potential $K_{NY}$ that is lower than that for the high $K_N$ value process.

In this manner, the two-stage gas nitriding process (high $K_N$ value process and low $K_N$ value process) is performed in the present nitriding method. By using a high nitriding potential $K_N$ value in the first part of the gas nitriding process (high $K_N$ value process), a compound layer is formed on the surface of a low alloy steel. Thereafter, by lowering the nitriding potential $K_N$ value in the latter part of the gas nitriding process (low $K_N$ value process), the compound layer formed on the surface of the low alloy steel is decomposed to allow nitrogen to penetrate and diffuse into the steel. By employing the two-stage gas nitriding process, sufficient hardened case depth is achieved using the nitrogen resulting from the decomposition of the compound layer while reducing the thickness of the compound layer.

The nitriding potential of the high $K_N$ value process is denoted as $K_{NX}$ and the nitriding potential of the low $K_N$ value process is denoted as $K_{NY}$. Here, the nitriding potential $K_{Ni}$ (i is X or Y) is defined by Formula (1).

$$K_{Ni}=(NH_3 \text{ partial pressure})/[(H_2 \text{ partial pressure})^{3/2}] \quad (1)$$

The partial pressures of $NH_3$ and $H_2$ in the atmosphere for the gas nitriding process can be controlled by regulating the gas flow rate. Accordingly, the nitriding potential $K_{Ni}$ can be regulated by the gas flow rate.

When the gas flow rate is regulated to lower the $K_{Ni}$ value in the transition from the high $K_N$ value process to the low $K_N$ value process, a certain period of time is necessary before the partial pressures of $NH_3$ and $H_2$ in the furnace are stabilized. The regulation of the gas flow rate to change the $K_{Ni}$ value may be carried out one time or several times (two or more times) as necessary. After the high $K_N$ value process and before the low $K_N$ value process, the $K_{Ni}$ value may be lowered once and then be raised. The point in time at which the $K_{Ni}$ value after the high $K_N$ value process falls to 0.25 or less for the last time is designated as the starting time of the low $K_N$ value process.

The process time of the high $K_N$ value process is denoted as "X" (in hours) and the process time of the low $K_N$ value process is denoted as "Y" (in hours). The sum of the process time X and the process time Y is within the range of the process time A for the entire nitriding process, and preferably equals the process time A.

[Conditions for High $K_N$ Value Process and Low $K_N$ Value Process]

As described above, the nitriding potential in the high $K_N$ value process determined by Formula (1) is denoted as "$K_{NX}$". The nitriding potential in the low $K_N$ value process determined by Formula (1) is denoted as "$K_{NY}$". Further, the average value of the nitriding potential during the high $K_N$ value process is denoted as "$K_{NXave}$" and the average value of the nitriding potential during the low $K_N$ value process is denoted as "$K_{NYave}$".

Further, the average nitriding potential value of the entire nitriding process is denoted as "$K_{Nave}$". The average value $K_{Nave}$ is defined by Formula (2).

$$K_{Nave}=(X\times K_{NXave}+Y\times K_{NYave})/A \quad (2)$$

In the nitriding method according to the present embodiment, the nitriding potential $K_{NX}$ of the high $K_N$ value process, the average value $K_{NXave}$, the process time X, the nitriding potential $K_{NY}$ of the low $K_N$ value process, the average value $K_{NYave}$, the process time Y, and the average value $K_{Nave}$ satisfy the following conditions (I) to (IV).

(I) Average value $K_{NXave}$: 0.30 to 0.80

(II) Average value $K_{NYave}$: 0.03 to 0.20

(III) $K_{NX}$: 0.15 to 1.50 and $K_{NY}$: 0.02 to 0.25

(IV) Average value $K_{Nave}$: 0.07 to 0.30

The conditions (1) to (IV) will be described below.

[(I) Average Value $K_{NXave}$ of Nitriding Potential in High $K_N$ Value Process]

In the high $K_N$ value process, the average value $K_{NXave}$ of the nitriding potential ranges from 0.30 to 0.80.

FIG. 1 is a graph illustrating the relationships between the average value $K_{NXave}$ of the nitriding potential of the high $K_N$ value process and the case hardness and also the compound layer thickness. FIG. 1 was obtained from the following experiment.

The gas nitriding process was performed in a gas atmosphere containing $NH_3$, $H_2$, and $N_2$ using SCr420 (hereinafter referred to as a test specimen), which is a JIS G 4053 low-alloyed steel for machine structural use. In the gas nitriding process, test specimens were placed into a furnace with atmosphere control capability which had been heated to a predetermined temperature, and $NH_3$, $N_2$, and $H_2$ gases were flowed thereinto. During that time, the nitriding potential $K_N$; value was controlled by regulating the gas flow rate while measuring the partial pressures of $NH_3$ and $H_2$ in the atmosphere for the gas nitriding process. The $K_{Ni}$ value was determined by Formula (1) using the $NH_3$ partial pressure and $H_2$ partial pressure.

The $H_2$ partial pressure during the gas nitriding process was measured, using a thermal conductivity $H_2$ sensor directly attached to the gas nitriding furnace body, by converting the thermal conductivity difference between the reference gas and the measured gas into a gas concentration. The $H_2$ partial pressure was continuously measured during the gas nitriding process. The $NH_3$ partial pressure during the gas nitriding process was measured with a manual glass tube $NH_3$ spectrometer attached outside the furnace, by which the partial pressure of the residual $NH_3$ was calculated and determined every 15 minutes. The nitriding potential $K_{Ni}$ value was calculated every 15 minutes at which the $NH_3$ partial pressure was measured, and the $NH_3$ flow rate and the $N_2$ flow rate were regulated so as to converge to the target values.

In the gas nitriding process, the temperature of the atmosphere was 590° C., the process time X was 1.0 hour, the process time Y was 2.0 hours, $K_{NYave}$ was 0.05, all of which were constant, and $K_{NXave}$ was varied within the range of 0.10 to 1.00. The total process time A was 3.0 hours.

The test specimens that had been gas nitrided with various average values $K_{NXave}$ were subjected to the following measurement test.

[Measurement of Thickness of Compound Layer]

After the gas nitriding process, the cross section of the test specimen was polished and etched to be observed with an optical microscope. The etching was carried out with a 3% nital solution for 20 to 30 seconds. The compound layer exists on the outer layer of the low alloy steel and can be observed as a white non-etched layer. Using structure micrographs of five visual fields (field area: $2.2\times10^4$ μm$^2$) taken with an optical microscope at a magnification of 500×, the thickness of the compound layer was measured at every 30 μm at four points for each field. The average value of values measured at the 20 points was designated as the compound layer thickness (μm). When the compound layer thickness is not more than 3 μm, the occurrences of delamination and cracking are significantly inhibited. Accordingly, in the present embodiment, the target compound layer thickness was set to not more than 3 μm.

[Measurement of Pore Area Fraction]

Furthermore, the area fraction of pores in the compound layer in the cross section of the test specimen was measured by optical microscope observation. The measurement was made on five fields (field area: $5.6\times10^3$ μm$^2$) at a magnification of 1000×, and for each field, the percentage of pores (hereinafter referred to as a pore area fraction) in an area of 25 μm$^2$ at a depth of 5 μm from the outermost surface was calculated. If the pore area fraction is not less than 10%, the nitrided parts after the gas nitriding process will have a rough surface roughness, and further, the nitrided parts will exhibit decreased fatigue strength due to embrittlement of the compound layer. Accordingly, in the present embodiment, the target pore area fraction was set to less than 10%.

[Measurement of Case Hardness]

Furthermore, the case hardness and effective hardened case depth of the gas nitrided test specimen were determined by the following method. The Vickers hardness in the depth direction from the test specimen surface was measured in accordance with JIS Z 2244 with a test force of 1.96 N. The average value of the Vickers hardnesses at three points at a position of 50 μm depth from the surface was designated as the case hardness (HV). Common gas nitriding processes, by which a compound layer more than 3 μm thick is left, provide a case hardness of 270 to 310 HV for JIS Standard S45C or a case hardness of 550 to 590 HV for JIS Standard SCr420. Accordingly, in the present embodiment, the target case hardness was set to not less than 290 HV for S45C and not less than 570 for SCr420.

[Measurement of Effective Hardened Case Depth]

The Vickers hardness was measured at positions of 50 μm, 100 μm, and every 50 μm from 100 μm to 1000 μm depth from the surface and, using the obtained hardness distribution in the depth direction, the effective hardened case depth was determined in the following manner. For S45C, in the distribution of Vickers hardnesses measured in the depth direction from the surface, the depth up to which the hardness is 250 HV or more was designated as the effective hardened case depth (μm). For SCr420, in the distribution of Vickers hardnesses measured in the depth direction from the surface, the depth up to which the hardness is 300 HV or more was designated as the effective hardened case depth (μm).

At process temperatures of 570 to 590° C., common gas nitriding processes, by which a compound layer 10 μm or more thick is formed, provide an effective hardened case depth within the range of the value obtained by Formula (A)±20 μm.

$$\text{Effective hardened case depth (μm)}=130\times\{\text{process time } A \text{ (in hours)}\}^{1/2} \quad (A)$$

Accordingly, in the present embodiment, the target effective hardened case depth was set to satisfying Formula (B).

$$\text{Effective hardened case depth } (\mu m) \geq 130 \times \{\text{process time } A \text{ (in hours)}\}^{1/2} \quad (B)$$

The results from the above-described measurement test indicated that, when the average value $K_{NYave}$ was 0.20 or more, the effective hardened case depth satisfied Formula (B) (when A=3, the effective hardened case depth was 225 μm). Furthermore, FIG. 1 was generated based on the case hardnesses and compound layer thicknesses of the test specimens, among the measurement test results, obtained from the gas nitriding processes with the respective average values $K_{NXave}$.

The solid line in FIG. 1 is a graph representing the relationship between the average value $K_{NXave}$ of the nitriding potential of the high $K_N$ value process and the case hardness (Hv). The dashed line in FIG. 1 is a graph representing the relationship between the average value $K_{NXave}$ of the nitriding potential of the high $K_N$ value process and the thickness (μm) of the compound layer. Referring to the graph of the solid line in FIG. 1, provided that the average value $K_{NYave}$ of the low $K_N$ value process is constant, the case hardness of the nitrided part significantly increases with the increase in the average value $K_{NXave}$ in the high $K_N$ value process. Then, when the average value $K_{NXave}$ has reached or exceeded 0.30, the case hardness reaches or exceeds 570 HV, which is the target for SCr420 test specimens. On the other hand, when the average value $K_{NXave}$ is higher than 0.30, the case hardness remains substantially constant even with further increase in the average value $K_{NXave}$. That is, in the graph plotting the case hardness versus average value $K_{NXave}$ (solid line in FIG. 1), an inflection point exists around the point of $K_{NXave}$=0.30.

Further, referring to the graph of the dashed line in FIG. 1, the compound layer thickness significantly decreases with the decrease in the average value $K_{NXave}$ from 1.00. Then, when the average value $K_{NXave}$ has reached 0.80, the thickness of the compound layer reaches or falls below 3 μm. On the other hand, in the range where the average value $K_{NXave}$ is not more than 0.80, the thickness of the compound layer decreases with the decrease in the average value $K_{NXave}$, but the rate of decrease in the thickness of the compound layer is smaller than in the range where the average value $K_{NXave}$ is higher than 0.80. That is, in the graph plotting the case hardness versus average value $K_{NXave}$ (solid line in FIG. 1), an inflection point exists around the point of $K_{NXave}$=0.80.

Based on the above results, the present embodiment specifies the average value $K_{NXave}$ of 0.30 to 0.80 for the nitriding potential of the high $K_N$ value process. This makes it possible to increase the case hardness of the nitrided low alloy steel and to inhibit the thickness of the compound layer. Furthermore, it is possible to achieve sufficient effective hardened case depth. If the average value $K_{NXave}$ is less than 0.30, the compound production will be insufficient, which results in a decrease in the case hardness, and therefore it is impossible to achieve sufficient effective hardened case depth. If the average value $K_{NXave}$ is more than 0.80, the thickness of the compound layer will exceed 3 μm, and further, the pore area fraction can be 10% or more. A preferred lower limit of the average value $K_{NXave}$ is 0.35. A preferred upper limit of the average value $K_{NXave}$ is 0.70.

[(II) Average Value $K_{NYave}$ of Nitriding Potential of Low $K_N$ Value Process]

The average value $K_{NYave}$ of the nitriding potential of the low $K_N$ value process ranges from 0.03 to 0.20.

Figure 2:
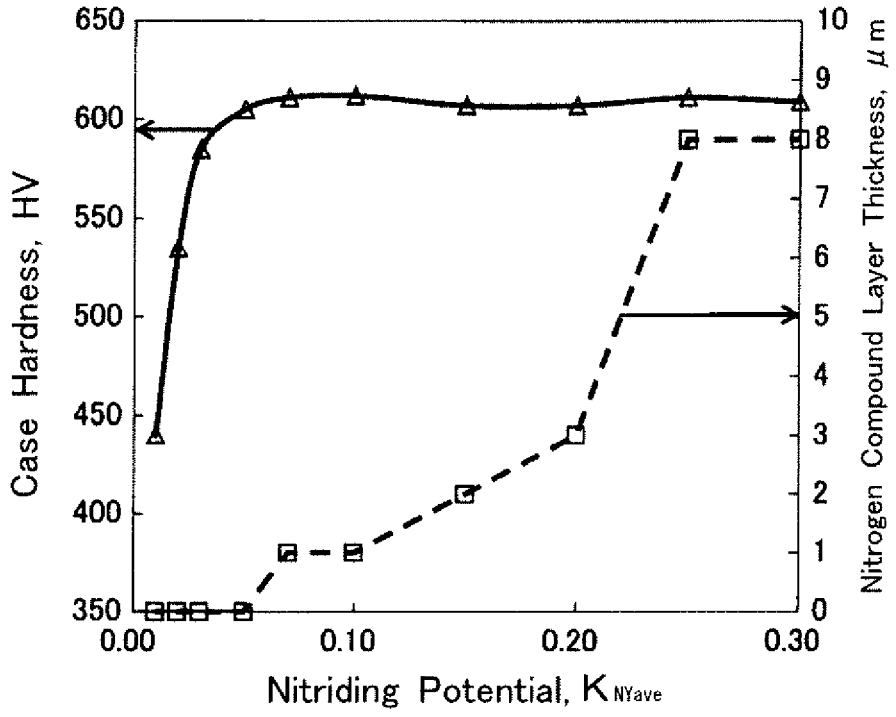
FIG. 2 is a graph illustrating the relationships between the average value $K_{NYave}$ of the nitriding potential of the low $K_N$ value process and the case hardness and also the compound layer thickness.

FIG. 2 is a graph illustrating the relationships between the average value $K_{NYave}$ of the nitriding potential of the low $K_N$ value process and the case hardness and also the compound layer thickness. FIG. 2 was obtained from the following test.

Gas nitriding processes were performed on test specimens having a chemical composition corresponding to that of SCr420, with a nitriding atmosphere temperature of 590° C., a process time X of 1.0 hour, a process time Y of 2.0 hours, and an average value $K_{NXave}$ of 0.40, each of which is constant, and with average values $K_{NYave}$ varied from 0.01 to 0.30. The total process time A was 3.0 hours. After the nitriding process, the case hardness (HV), the effective hardened case depth (μm), and the compound layer thickness (μm) were measured at each average value $K_{NYave}$ using the above-described technique. Measurement of the effective hardened case depths revealed that, when the average value $K_{NYave}$ was not less than 0.02, the effective hardened case depth was 225 μm or more. Further, the case hardnesses and compound layer thicknesses obtained from the measurement test were plotted to generate FIG. 2.

In FIG. 2, the solid line is a graph representing the relationship between the average value $K_{NYave}$ of the nitriding potential of the low $K_N$ value process and the case hardness, and the dashed line is a graph representing the relationship between the average value $K_{NYave}$ of the nitriding potential of the low K value process and the compound layer depth. Referring to the graph of the solid line in FIG. 2, the case hardness significantly increases with the increase in the average value $K_{NYave}$ from zero. When $K_{NYave}$ has reached 0.03, the case hardness reaches or exceeds 570 HV. Furthermore, when $K_{NYave}$ is 0.03 or more, the case hardness remains substantially constant even with an increase in $K_{NYave}$. The above indicates that, in the graph plotting the case hardness versus average value $K_{NYave}$, an inflection point exists around the point of the average value $K_{NYave}$=0.03.

On the other hand, referring to the graph of the dashed line in FIG. 2, the thickness of the compound layer remains substantially constant in the average value $K_{NYave}$ range of from 0.30 down to 0.25. However, the thickness of the compound layer significantly decreases with the decrease in the average value $K_{NYave}$ from 0.25. Then, when the average value $K_{NYave}$ has reached 0.20, the thickness of the compound layer reaches or falls below 3 lam. In the range where the average value $K_{NYave}$ is not more than 0.20, the thickness of the compound layer decreases with the decrease in the average value $K_{NYave}$, but the rate of decrease in the thickness of the compound layer is smaller than in the range where the average value $K_{NYave}$ is higher than 0.20. The above indicates that, in the graph plotting the thickness of the compound layer versus average value $K_{NYave}$, an inflection point exists around the point of the average value $K_{NYave}$=0.20.

Based on the above results, the present embodiment specifies the average value $K_{NYave}$ of 0.03 to 0.20 for the low $K_N$ value process. This makes it possible to increase the case hardness of the gas nitrided low alloy steel and to inhibit the thickness of the compound layer. Furthermore, it is possible to achieve sufficient effective hardened case depth. If the average value $K_{NYave}$ is less than 0.03, denitrification will occur at the surface, resulting in a decrease in the case hardness. On the other hand, if the average value $K_{NYave}$ is more than 0.20, decomposition of the compound will be insufficient, resulting in a shallow effective hardened case depth and thus a decrease in the case hardness. A preferred lower limit of the average value $K_{NYave}$ is 0.05. A preferred upper limit of the average value $K_{NYave}$ is 0.18.

[(III) Ranges of Nitriding Potentials $K_{NX}$ and $K_{NY}$ During Nitriding Process]

In a gas nitriding process, a certain period of time is necessary before the $K_{Ni}$ value of the atmosphere reaches an equilibrium after the gas flow rate is set. Thus, the $K_{Ni}$ value varies from moment to moment before the $K_N$ value reaches the equilibrium. Furthermore, at the transition from the high $K_N$ value process to the low $K_N$ value process, the setting of the $K_{Ni}$ value is to be altered during the gas nitriding process. Also in this instance, the $K_{Ni}$ value varies before reaching the equilibrium.

Such variations in the $K_{Ni}$ value affect the compound layer thickness and the hardened case depth. Accordingly, in the high $K_N$ value process and low $K_N$ value process, not only the above-described average value $K_{NXave}$ and average value $K_{NYave}$ are controlled to be within the above range, but also the nitriding potential $K_{NX}$ during the high $K_N$ value process and the nitriding potential $K_{NY}$ during the low $K_N$ value process are controlled to be within a predetermined range.

Specifically, the present embodiment specifies that the nitriding potential $K_{NX}$ during the high $K_N$ value process be within a range of 0.15 to 1.50 and that the nitriding potential $K_{NY}$ during the low $K_N$ value process be within a range of 0.02 to 0.25.

Table 1 shows compound layer thicknesses (μm), pore area fractions (%), effective hardened case depths (μm), and case hardnesses (HV) of nitrided parts obtained from nitriding processes performed with various nitriding potentials $K_{NX}$ and $K_{NY}$. Table 1 was obtained from the following test.

TABLE 1

| | | High $K_N$ value process | | | | Low $K_N$ value process | | | | Nitriding process | | | | | |
|---|---|---|---|---|---|---|---|---|---|---|---|---|---|---|---|
| | | | Nitriding potential | | | | Nitriding potential | | | | | Compound | | Effective hardened case | |
| Test No. | Temperature (° C.) | Time X (h) | Minimum $K_{NXmin}$ | Maximum $K_{NXmax}$ | Average $K_{NXave}$ | Time Y (h) | Minimum $K_{NYmin}$ | Maximum $K_{NYmax}$ | Average $K_{NYave}$ | Time A (h) | Nitriding potential Average $K_{Nave}$ | layer thickness (μm) | Pore (%) | depth (actual value) (μm) | Case hardness (Hv) |
| 1 | 590 | 1.0 | 0.12 | 0.50 | 0.40 | 2.0 | 0.05 | 0.15 | 0.10 | 3.0 | 0.20 | None | 2 | 199 | 514 |
| 2 | 590 | 1.0 | 0.14 | 0.50 | 0.40 | 2.0 | 0.05 | 0.15 | 0.10 | 3.0 | 0.20 | None | 2 | 242 | 532 |
| 3 | 590 | 1.0 | 0.15 | 0.50 | 0.40 | 2.0 | 0.05 | 0.15 | 0.10 | 3.0 | 0.20 | 1 | 4 | 241 | 591 |
| 4 | 590 | 1.0 | 0.25 | 0.50 | 0.40 | 2.0 | 0.05 | 0.15 | 0.10 | 3.0 | 0.20 | 1 | 4 | 240 | 594 |
| 5 | 590 | 1.0 | 0.25 | 1.40 | 0.40 | 2.0 | 0.05 | 0.15 | 0.10 | 3.0 | 0.20 | 2 | 8 | 238 | 598 |
| 6 | 590 | 1.0 | 0.25 | 1.50 | 0.40 | 2.0 | 0.05 | 0.15 | 0.10 | 3.0 | 0.20 | 2 | 9 | 241 | 603 |
| 7 | 590 | 1.0 | 0.30 | 1.55 | 0.40 | 2.0 | 0.05 | 0.15 | 0.10 | 3.0 | 0.20 | 3 | 14 | 242 | 608 |
| 8 | 590 | 1.0 | 0.30 | 1.60 | 0.40 | 2.0 | 0.05 | 0.15 | 0.10 | 3.0 | 0.20 | 5 | 16 | 245 | 607 |
| 9 | 590 | 1.0 | 0.30 | 0.50 | 0.40 | 2.0 | 0.01 | 0.15 | 0.10 | 3.0 | 0.20 | None | 3 | 242 | 501 |
| 10 | 590 | 1.0 | 0.30 | 0.50 | 0.40 | 2.0 | 0.02 | 0.15 | 0.10 | 3.0 | 0.20 | None | 3 | 243 | 590 |
| 11 | 590 | 1.0 | 0.30 | 0.50 | 0.40 | 2.0 | 0.03 | 0.15 | 0.10 | 3.0 | 0.20 | None | 3 | 247 | 593 |
| 12 | 590 | 1.0 | 0.30 | 0.50 | 0.40 | 2.0 | 0.05 | 0.15 | 0.10 | 3.0 | 0.20 | 1 | 3 | 241 | 596 |
| 13 | 590 | 1.0 | 0.30 | 0.50 | 0.40 | 2.0 | 0.05 | 0.20 | 0.10 | 3.0 | 0.20 | 2 | 4 | 240 | 594 |
| 14 | 590 | 1.0 | 0.30 | 0.50 | 0.40 | 2.0 | 0.05 | 0.22 | 0.10 | 3.0 | 0.20 | 2 | 4 | 242 | 599 |
| 15 | 590 | 1.0 | 0.30 | 0.50 | 0.40 | 2.0 | 0.05 | 0.25 | 0.10 | 3.0 | 0.20 | 3 | 5 | 244 | 602 |
| 16 | 590 | 1.0 | 0.30 | 0.50 | 0.40 | 2.0 | 0.05 | 0.27 | 0.10 | 3.0 | 0.20 | 8 | 5 | 248 | 608 |

Using SCr420 test specimens, the gas nitriding processes shown in Table 1 (high $K_N$ value process and low $K_N$ value process) were performed on them to produce nitrided parts. Specifically, for each gas nitriding process of each test number, the ambient temperature was 590° C., the process time X was 1.0 hour, the process time Y was 2.0 hours, $K_{NXave}$ was 0.40, and $K_{NYave}$ was 0.10, all of which were constant. The high $K_N$ value processes and low $K_N$ value processes were performed with various minimum $K_{NX}$ values $K_{NXmin}$, minimum $K_{NY}$ values $K_{NYmin}$, maximum $K_{NX}$ values $K_{NXmax}$, and maximum $K_{NY}$ values $K_{NYmax}$ in the gas nitriding processes. The process time A for the entire nitriding process was 3.0 hours. The compound layer thickness, pore area fraction, effective hardened case depth, and case hardness of each nitrided part after the gas nitriding process were measured using the above-described measurement technique to obtain Table 1.

Referring to Table 1, in Tests Nos. 3 to 6 and Nos. 10 to 15, the minimum value $K_{NXmin}$ and maximum value $K_{NXmax}$ ranged from 0.15 to 1.50 and the minimum value $K_{NYmin}$ and maximum value $K_{NYmax}$ ranged from 0.02 to 0.25. As a result, their compound layers were thin at 3 μm or less and pores therein were reduced to less than 10%. Further, their effective hardened case depths were not less than 225 μm and the case hardnesses were not less than 570 HV. In all numbers of tests in Table 1, the values obtained by Formula (A) (target values for effective hardened case) were 225 μm, and the effective hardened case depths of the above-mentioned test numbers were not less than 225 μm while satisfying Formula (B).

In contrast, in Tests Nos. 1 and 2, $K_{NXmin}$ was less than 0.15 and, as a result, the case hardness was less than 570 HV. Furthermore, in Test No. 1, $K_{NXmin}$ was less than 0.14 and, as a result, the effective hardened case depth was less than 225 μm.

In Tests Nos. 7 and 8, $K_{NXmax}$ was more than 1.5 and, as a result, pores constituted 10% or more of the compound layer. Furthermore, in Test No. 8, $K_{NXmax}$ was more than 1.55 and, as a result, the thickness of the compound layer was more than 3 μm.

In Test No. 9, $K_{NYmin}$ was less than 0.02 and, as a result, the case hardness was less than 570 HV. This is considered to be because the low $K_N$ value process not only eliminated the compound layer but also caused denitrification at the outer layer. In Test No. 16, $K_{NYmax}$ was more than 0.25. As a result, the thickness of the compound layer was more than 3 μm. This is considered to be because sufficient decomposition did not occur due to the $K_{NYmax}$ of more than 0.25.

Based on the above results, the nitriding potential $K_{NX}$ ranging from 0.15 to 1.50 is specified for the high $K_N$ value process, and the nitriding potential $K_{NY}$ ranging from 0.02 to 0.25 is specified for the low $K_N$ value process. This makes it possible to sufficiently reduce the thickness of the compound layer of the nitrided parts and also to inhibit pores therein. Furthermore, it is possible to achieve sufficient depth of the effective hardened case depth and obtain high case hardness.

If the nitriding potential $K_{NX}$ is less than 0.15, the effective hardened case will be too shallow and/or the case hardness will be too low. If the nitriding potential $K_{NX}$ is more than 1.50, the compound layer will become too thick and/or excessive amounts of pores will remain.

If the nitriding potential $K_{NY}$ is less than 0.02, denitrification will occur, resulting in a decrease in the case hardness. On the other hand, if the nitriding potential $K_{NY}$ is more than 0.20, the compound layer will become too thick. Accordingly, in the present embodiment, the nitriding potential $K_{NX}$ during the high $K_N$ value process is within the range of 0.15 to 1.50, and the nitriding potential $K_{NY}$ during the low $K_N$ value process is within the range of 0.02 to 0.25.

A preferred lower limit of the nitriding potential $K_{NX}$ is 0.25. A preferred upper limit of $K_{NX}$ is 1.40. A preferred lower limit of $K_{NY}$ is 0.03. A preferred upper limit of $K_{NY}$ is 0.22.

[(IV) Average Nitriding Potential Value $K_{Nave}$ Throughout Nitriding Process]

The gas nitriding process of the present embodiment further specifies that the average nitriding potential value $K_{Nave}$ defined by Formula (2) be within a range of 0.07 to 0.30.

$$K_{Nave}=(X\times K_{NXave}+Y\times K_{NYave})/A \quad (2)$$

Figure 3:
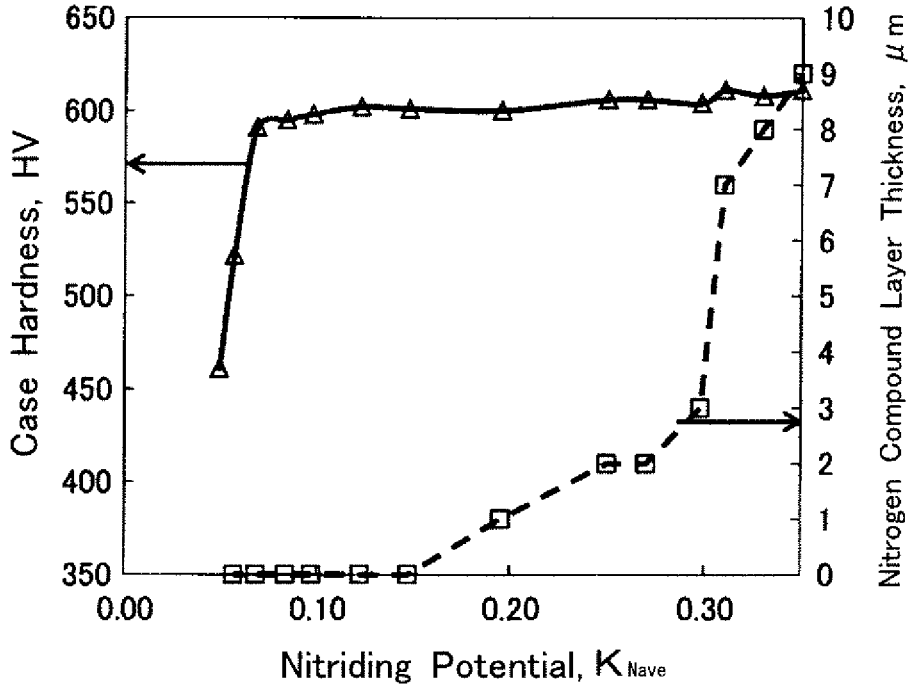
FIG. 3 is a graph illustrating the relationships between the average nitriding potential value $K_{Nave}$ and the case hardness and also the compound layer thickness.

FIG. 3 is a graph illustrating the relationships between the average nitriding potential value $K_{Nave}$ and the case hardness (HV) and also the compound layer thickness (μm). FIG. 3 was obtained by conducting the following test. Using SCr420 test specimens, gas nitriding processes were performed thereon. The specified ambient temperature for the gas nitriding processes was 590° C. Using various process times X, process times Y, and nitriding potential ranges and average values ($K_{NX}$, $K_{NY}$, $K_{NXave}$, $K_{NYave}$), the gas nitriding processes (high $K_N$ value process and low $K_N$ value process) were performed. The effective hardened case depths, compound layer thicknesses, and case hardnesses of the gas nitrided test specimens under the respective test conditions were measured using the above-described technique. As a result, it was found that, when the average value $K_{Nave}$ is not less than 0.06, the effective hardened case depth satisfies Formula (B). Further, the resultant compound layer thicknesses and case hardnesses were measured to generate FIG. 3.

The solid line in FIG. 3 is a graph representing the relationship between the average nitriding potential value $K_{Nave}$ and the case hardness (HV). The dashed line in FIG. 3 is a graph representing the relationship between the average nitriding potential value $K_{Nave}$ and the thickness (μm) of the compound layer.

Referring to the graph of the solid line in FIG. 3, the case hardness significantly increases with the increase in the average value $K_{Nave}$ from zero and, at the average value $K_{Nave}$ of 0.07, it reaches or exceeds 570 HV. In the range where the average value $K_{Nave}$ is 0.07 or more, the case hardness remains substantially constant even with the increase in the average value $K_{Nave}$. That is, in the graph plotting the case hardness (HV) versus average value $K_{Nave}$, an inflection point exists around the point of the average value $K_{Nave}$=0.07.

Further, referring to the graph of the dashed line in FIG. 3, the compound layer thickness significantly decreases with the decrease in the average value $K_{Nave}$ from 0.35 and, at the average value $K_{Nave}$ of 0.30, it reaches or falls below 3 μm. In the range where the average value $K_{Nave}$ is less than 0.30, the thickness of the compound layer gradually decreases with the decrease in the average value $K_{Nave}$, but the rate of decrease in the thickness of the compound layer is smaller than in the range where the average value $K_{Nave}$ is higher than 0.30. The above indicates that, in the graph plotting the thickness of the compound layer versus average value $K_{Nave}$, an inflection point exists around the point of the average value $K_{Nave}$=0.30.

Based on the above results, the gas nitriding process of the present embodiment specifies that the average value $K_{Nave}$ defined by Formula (2) be within the range of 0.07 to 0.30. This makes it possible to obtain gas nitrided parts having a sufficiently thin compound layer. Further, it is possible to obtain high case hardness. If the average value $K_{Nave}$ is less than 0.07, the case hardness will be low and the effective hardened case will be shallow. On the other hand, if the average value $K_{Nave}$ is more than 0.30, the compound layer will be more than 3 min. A preferred lower limit of the average value $K_{Nave}$ is 0.08. A preferred upper limit of the average value $K_{Nave}$ is 0.27. When the average value $K_{Nave}$ is 0.06 or more, the effective hardened case depth satisfies Formula (B).

[Process Times of High $K_N$ Value Process and Low $K_N$ Value Process]

The process time X of the high $K_N$ value process and the process time Y of the low $K_N$ value process are not particularly limited as long as the average value $K_{Nave}$ defined by Formula (2) is within the range of 0.07 to 0.30. Preferably, the process time X is not less than 0.50 hours and the process time Y is not less than 0.50 hours.

Under the above conditions, the gas nitriding process is performed. Specifically, the high $K_N$ value process is performed under the above conditions and thereafter the low $K_N$ value process is performed under the above conditions. After the low $K_N$ value process, the gas nitriding process is terminated without increasing the nitriding potential.

Nitrided parts are produced by performing the above gas nitriding process. The produced nitrided parts (made of low alloy steel) have sufficiently high case hardness and a sufficiently thin compound layer. Further, their effective hardened case depths are sufficiently deep and the pores in their compound layers are inhibited. Preferably, nitrided parts produced by performing the nitriding process of the present embodiment have a case hardness of 570 HV or more (when the nitrided parts are made of SCr420) or a case hardness of 290 HV or more (when the nitrided parts are made of S45C), both on the Vickers hardness scale, with a compound layer depth of not more than 3 μm. Further, they satisfy Formula (B). Further, their pore area fractions are less than 10%.

Examples

A JIS SCr420 steel (JIS G 4053 low-alloyed steel for machine structural use) and a JIS S45C steel (JIS G 4051 carbon steel for machine structural use) were each melted in a 50 kg vacuum furnace to form molten steels. The molten steels were cast into ingots. The ingots were hot forged into steel bars having a diameter of 20 mm.

The steel bar of SCr420 was subjected to a normalizing treatment to homogenize the structure and then subjected to quenching and tempering. In the normalizing treatment, the steel bar was heated to 920° C. and held for 30 minutes and then air cooled. In the quenching treatment, the steel bar was heated to 900° C. and held for 30 minutes and then water cooled. In the tempering treatment, the steel bar was held at 600° C. for one hour.

The steel bar of S45C was heated to 870° C. and held for 30 minutes and then air cooled.

Test specimens measuring 15 mm×80 mm×5 mm were cut from the produced steel bar by machining.

Gas nitriding processes were performed on the cut test specimens under the following conditions. The test specimens were loaded into a gas nitriding furnace, and an $NH_3$ gas, a $H_2$ gas, and a $N_2$ gas were introduced into the furnace. Subsequently, high $K_N$ value processes under the conditions shown in Table 2 were performed, which were followed by low $K_N$ value processes. The gas nitrided test specimens were subjected to oil cooling using oil at 80° C.

TABLE 2

| | | | High $K_N$ value process | | | | Low $K_N$ value process | | | |
|---|---|---|---|---|---|---|---|---|---|---|
| | | | | Nitriding potential | | | | Nitriding potential | | |
| Test No. | Steel grade | Temperature (° C.) | Time X (h) | Minimum $K_{NXmin}$ | Maximum $K_{NXmax}$ | Average $K_{NXave}$ | Time Y (h) | Minimum $K_{NYmin}$ | Maximum $K_{NYmax}$ | Average $K_{NYave}$ |
| 21 | S45C | 590 | 0.5 | 0.16 | 0.45 | 0.30 | 3.0 | 0.02 | 0.15 | 0.03 |
| 22 | | 590 | 2.0 | 0.20 | 0.50 | 0.33 | 1.0 | 0.03 | 0.15 | 0.12 |
| 23 | | 590 | 1.5 | 0.30 | 0.60 | 0.40 | 8.0 | 0.10 | 0.25 | 0.15 |
| 24 | | 590 | 1.0 | 0.40 | 2.00 | 0.79 | 2.5 | 0.03 | 0.15 | 0.06 |
| 25 | | 590 | 0.5 | 0.10 | 0.35 | 0.15 | 1.5 | 0.02 | 0.08 | 0.03 |
| 26 | SCr420 | 590 | 1.0 | 0.40 | 0.80 | 0.50 | 1.5 | 0.03 | 0.15 | 0.05 |
| 27 | | 590 | 1.0 | 0.38 | 0.30 | 0.50 | 1.0 | 0.03 | 0.11 | 0.05 |
| 28 | | 590 | 0.1 | 0.20 | 0.50 | 0.30 | 3.9 | 0.03 | 0.20 | 0.07 |
| 29 | | 590 | 1.0 | 0.20 | 0.50 | 0.70 | 6.0 | 0.10 | 0.30 | 0.25 |
| 30 | | 590 | 0.5 | 0.25 | 0.50 | 0.35 | 2.0 | 0.02 | 0.03 | 0.02 |

| | | Nitriding process | | | | Effective hardened case | Effective hardened | | |
|---|---|---|---|---|---|---|---|---|---|
| Test No. | Steel grade | Time A (h) | Nitriding potential Average $K_{Nave}$ | Compound layer thickness (μm) | Pore (%) | depth (actual value) (μm) | case depth (target) (μm) | Case hardness (Hv) | Remarks |
| 21 | S45C | 3.5 | 0.07 | None | 3 | 270 | 243 | 311 | Inventive |
| 22 | | 3.0 | 0.26 | 2 | 5 | 263 | 225 | 325 | example |
| 23 | | 9.5 | 0.19 | None | 2 | 423 | 401 | 310 | |
| 24 | | 3.5 | 0.27 | 3 | *12 | 270 | 243 | 299 | Comparative |
| 25 | | 2.0 | 0.06 | None | 6 | *160 | 184 | *260 | example |
| 26 | SCr420 | 2.5 | 0.23 | 1 | 5 | 230 | 206 | 601 | Inventive |
| 27 | | 2.0 | 0.28 | 2 | 5 | 228 | 184 | 608 | example |
| 28 | | 4.0 | 0.08 | None | 6 | 294 | 260 | 599 | |
| 29 | | 7.0 | 0.31 | *9 | 8 | 370 | 344 | 606 | Comparative |
| 30 | | 2.5 | 0.09 | None | 2 | 213 | 206 | *502 | example |

Underline denotes that the value is out of the range of the present invention.
*denotes that the value docs not satisfy the target of the present invention.

[Measurement Test for Compound Layer Thickness and Pore Area Fraction]

The cross sections perpendicular to the lengthwise direction of the gas nitrided test specimens were mirror polished and etched. The etched cross sections were observed with an optical microscope to measure the compound layer thickness and investigate whether the pores in the near-surface portion were present. The etching was carried out with a 3% nital solution for 20 to 30 seconds.

The compound layer is identifiable as a white non-etched layer present at the outer layer. Compound layers were observed in structure micrographs of five fields (field area: $2.2\times10^4$ $\mu m^2$) taken at a magnification of 500× and the thickness of the compound layer was measured every 30 μm at four points for each field. The average value of values measured at the 20 points was designated as the compound layer thickness (μm).

Further, the etched cross sections were each observed at five fields at a magnification of 1000× to determine the proportion of pores in an area of 25 $\mu m^2$ at a depth of 5 μm from the outermost surface (pore area fraction, in %).

[Measurement Test for Case Hardness and Effective Hardened Case]

Vickers hardnesses of the gas nitrided steel bars of the respective test numbers were measured at positions of 50 μm, 100 μm, and every 50 μm from 100 μm to 1000 μm depth from the surface, with a test force of 1.96 N, in accordance with JIS Z 2244. The Vickers hardnesses (HV) were measured at three points for each and the average values thereof were determined. The case hardness was defined as the average value of values at three points positioned 50 μm from the surface.

Based on the measured Vickers hardnesses, effective hardened case depths of the steel bars of the respective test numbers were determined in the following manner. For SCr420 (Test Nos. 26 to 30), in the distribution of Vickers hardnesses measured in the depth direction from the surface, the depth up to which the hardness is 300 HV or more was designated as the effective hardened case depth (μm). For S45C (Test Nos. 21 to 25), in the distribution of Vickers hardnesses measured in the depth direction from the surface, the depth up to which the hardness is 250 HV or more was designated as the effective hardened case depth (μm).

Compound layer thicknesses of not more than 3 μm, pore percentages of less than 10%, and case hardnesses of not less than 290 HV for S45C or not less than 570 HV for SCr420 were evaluated as being good. Further, effective hardened case depths of not less than 225 HV with Formula (B) satisfied were evaluated as being good.

[Test Results]

The results are shown in Table 2. In Table 2, the "Effective hardened case depth (target)" section lists values (target values) calculated by Formula (A) and the "Effective hardened case depth (actual values)" lists measured values (μm) of the effective hardened cases. Referring to Table 2, in Tests Nos. 21 to 23 and Tests Nos. 26 to 28, the process temperatures for the gas nitriding processes were within the range of 550 to 620° C. and the process times A were within the range of 1.5 to 10 hours. Further, in the high $K_N$ value processes, $K_{NX}$s were within the range of 0.15 to 1.50 and the average values $K_{NXave}$ were within the range of 0.30 to 0.80. Further, in the low $K_N$ value processes, $K_{NY}$s were within the range of 0.02 to 0.25 and the average values $K_{NYave}$ were within the range of 0.03 to 0.20. Further, the average values $K_{Nave}$ determined by Formula (2) were within the range of 0.07 to 0.30. As a result, in each of the test numbers, after the nitriding processes, the thicknesses of the compound layers were not more than 3 μm and the pore area fractions were less than 10%. Further, the effective hardened cases were not less than 225 μm and Formula (B) was satisfied. Further, S45Cs of Test Nos. 21 to 23 each had a case hardness of not less than 290 HV and SCr420s of Test Nos. 26 to 28 each had a case hardness of not less than 570 HV.

In Test No. 24, the maximum $K_{NX}$ value in the high $K_N$ value process was more than 1.50. As a result, the pore area fraction was not less than 10%.

In Test No. 25, in the high $K_N$ value process, the minimum $K_{NX}$ value was less than 0.15 and the average value $K_{NXave}$ was less than 0.30. Further, the average value $K_{Nave}$ was less than 0.07. As a result, the depth of the effective hardened case was less than the value defined by Formula (B) and the case hardness was less than 290 HV.

In Test No. 29, in the low $K_N$ value process, $K_{NY}$ was more than 0.25 and the average value $K_{NYave}$ was more than 0.20. Further, the average value $K_{Nave}$ was more than 0.30. As a result, the thickness of the compound layer was more than 3 μm.

In Test No. 30, the average value $K_{NYave}$ in the low $K_N$ value process was less than 0.03. As a result, the case hardness was less than 570 HV.

In the foregoing specification, an embodiment of the present invention has been described. However, the above embodiment is merely an illustrative example by which the present invention is implemented. Accordingly, the present invention is not limited to the above embodiment, and modifications of the above embodiment may be made appropriately without departing from the spirit and scope of the invention.

The invention claimed is:

1. A nitriding method, comprising a gas nitriding step in which a low alloy steel is heated to a temperature ranging from 550 to 620° C. in a gas atmosphere containing $NH_3$, $H_2$, and $N_2$, the gas nitriding step being performed for a total process time of A ranging from 1.5 to 10 hours, the gas nitriding step including the steps of:

performing a high $K_N$ value process with a nitriding potential $K_{NX}$ determined by Formula (1) ranging from 0.15 to 1.50 and with an average value $K_{NXave}$ of the nitriding potential $K_{NX}$, the average value $K_{NXave}$ ranging from 0.30 to 0.80, the high $K_N$ value process being performed for a process time of X in hours, and performing a low $K_N$ value process after the high $K_N$ value process, the low $K_N$ value process being performed with a nitriding potential $K_{NY}$ determined by Formula (1) ranging from 0.02 to 0.25 and with an average value $K_{NYave}$ of the nitriding potential $K_{NY}$, the average value $K_{NYave}$ ranging from 0.03 to 0.20, the low $K_N$ value process being performed for a process time of Y in hours, wherein an average nitriding potential value $K_{Nave}$ determined by Formula (2) ranges from 0.07 to 0.30, wherein a thickness of a compound layer, which is formed on a surface of the alloy steel by the gas nitriding step, is not more than 3 μm, $$K_{Ni}=(NH_3 \text{ partial pressure})/[(H_2 \text{ partial pressure})^{3/2}] \quad (1)$$

$$K_{Nave}=(X\times K_{NXave}+Y\times K_{NYave})/A \quad (2)$$

where i is X or Y.

2. A method for producing a nitrided part, the method comprising the steps of:

preparing a low alloy steel, and performing the nitriding method according to claim 1 on the low alloy steel to produce the nitrided part.

* * * * *